US005541613A

United States Patent [19]

Lam et al.

[11] Patent Number: 5,541,613

[45] Date of Patent: Jul. 30, 1996

[54] EFFICIENT BROADBAND ANTENNA SYSTEM USING PHOTONIC BANDGAP CRYSTALS

[75] Inventors: Juan F. Lam, Agoura Hills; Ronald I. Wolfson; Jerome Glaser, both of Los Angeles, all of Calif.

[73] Assignee: Hughes Aircraft Company, Hughes Electronics, Los Angeles, Calif.

[21] Appl. No.: 333,913

[22] Filed: Nov. 3, 1994

[51] Int. Cl.[6] ..... H01Q 11/00

[52] U.S. Cl. ..... 343/792.5; 343/793; 343/895

[58] Field of Search ..... 343/792.5, 793, 343/895, 909, 911 R

[56] References Cited

U.S. PATENT DOCUMENTS

| | | | |
|---|---|---|---|
| 5,187,461 | 2/1993 | Brommer et al. | 333/219.1 |
| 5,191,351 | 3/1993 | Hofer et al. | 343/895 |
| 5,216,680 | 6/1993 | Magnusson et al. | 372/20 |
| 5,386,215 | 1/1995 | Brown | 343/795 |

OTHER PUBLICATIONS

K. M. Ho, C. T. Chan, C. M. Soukoulis, "Existence of Phtonic Ban Gap in Periodic Dielectric Structures", *Phys. Rev. Lett* 67, 3152 (1990).

E. Yablonovitch, "Photonic Bandgap Structures", *J. Opt. Soc. Am.* b 10, 283 (1993).

E. R. Brown, C. D. Parker, E. Yablonovitch, "Radiation Properties of a Planar Antenna on a Photonic–Crystal Substrate", *J. Opt. Soc. Am.* B 10, 404 (1993).

Log–Periodic Dipole Arrays, *The Electrical Engineering Handbook*, pp. 868–869, edited by Richard C. Dorf, CRC Press, London (1993).

*Primary Examiner*—Donald T. Hajec
*Assistant Examiner*—Tan Ho
*Attorney, Agent, or Firm*—Duraiswamy V. D.; W. K. Denson-Low

[57] ABSTRACT

A broadband antenna system utilizes multiple photonic bandgap crystals to achieve nearly 100 percent power efficiency over a larger range of frequencies than prior antenna systems. Multiple custom tailored photonic bandgap crystals form a substrate for the antenna system. Each of the crystals is designed to cover a specific range of frequencies. The multiple crystals are attached together to form a photonic bandgap substrate whose bandwidth varies as a function of location on the substrate. A broadband antenna that can cover a wide frequency range, and whose active region shifts to different portions of the antenna as a function of frequency, is formed on the substrate such that the active region of the antenna is always on a crystal that has a corresponding operating bandwidth. The photonic bandgap crystals provide a nearly 100 percent efficient reflector for radiation emitted into the substrate that would otherwise be trapped or dissipated therein.

10 Claims, 2 Drawing Sheets

FIG.5.
( PRIOR ART )
| CERAMIC | $\varepsilon_r$ | CTE ( ppm/°C ) | Q 2 GHz | Q 20 GHz |
|---|---|---|---|---|
| $Ba_2Ti_9O_{20}$ | 40 | 2 | 15000 | 2000 |
| $Zr_{0-8}TiSn_{0-2}O_4$ | 38 | 0 | 15000 | 3000 |
| $BaTi_u[(Ni\ Zn_{1-x})_{1/3}Ta_{2/3}]_{1-u}O_3$ | 30 | -3...3 | 26000 | 5000 |
| $Ba[Sn_x(Mg_{1/3}Ta_{2/3})_{1-x}]\ O_3$ | 25 | ≈ 0 | >40000 | 10000 |
| $Nd_2O_3$-BaO -$TiO_2$-$Bi_2O_3$ | ≈ 90 | ≈ 0 | 3000 | — |
| $Mg_2Ca\ Ti_4$+ Ca $TiO_3$ | 14-140 | 8.4-10.7 | >1000 | 500 |
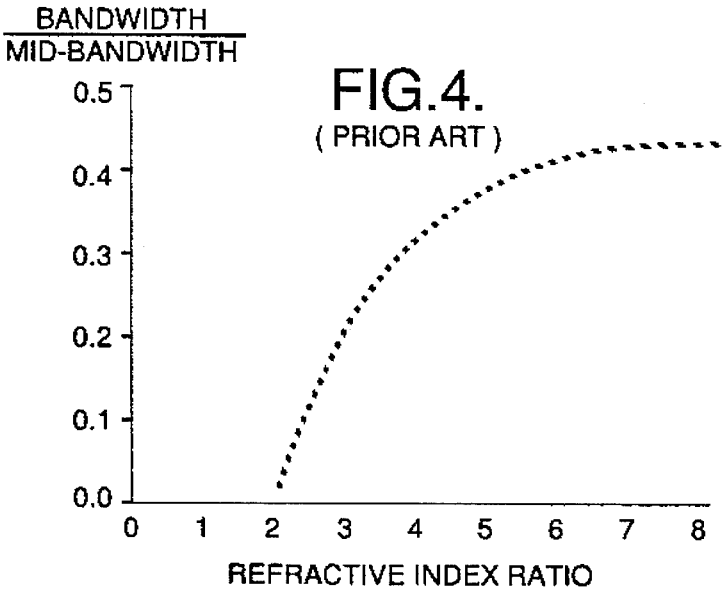
FIG.4.
( PRIOR ART )
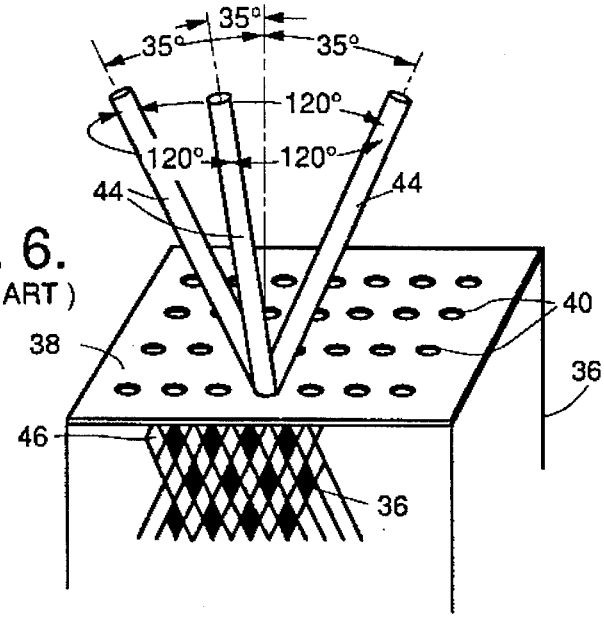
FIG. 6.
( PRIOR ART )

EFFICIENT BROADBAND ANTENNA SYSTEM USING PHOTONIC BANDGAP CRYSTALS

BACKGROUND OF THE INVENTION

1. Field of the Invention

The present invention relates to antenna systems. More specifically, the present invention relates to the use of photonic bandgap crystals as efficient reflectors for broadband antenna systems.

2. Description of the Related Art

Antennas are widely utilized in microwave and millimeter-wave integrated circuits for radiating signals from an integrated chip into free space. These antennas are typically fabricated monolithically on III-V semiconductor substrate materials such as GaAs or InP.

To understand the problems associated with antennas fabricated on semiconductor substrates, one needs to look at the fundamental electromagnetic properties of a conductor on a dielectric surface. Antennas, in general, emit radiation over a well defined three-dimensional angular pattern. For an antenna fabricated on a dielectric substrate with a dielectric constant $\epsilon_r$, the ratio of the power radiated into the substrate to the power radiated into the air is $\epsilon_r^{3/2}$. Thus, a planar antenna on a GaAs substrate ($\epsilon_r$=12.8) radiates 46 times more power into the substrate than into the air.

Another problem is that the power radiated into the substrate at angles greater than $$\theta_c=\sin^{-1}\epsilon_r^{-1/2}$$

is totally internally reflected at the top and bottom substrate-air interfaces. In GaAs, for instance, this occurs at an angle of 16 degrees. As a result, the vast majority of the radiated power is trapped in the substrate.

Some of this lost power can be recovered by placing a groundplane (a conducting plane beneath the dielectric) one-quarter wavelength behind the radiating surface of the antenna. This technique is acceptable provided the antenna emits monochromatic radiation. In the case of an antenna that emits a range of frequencies (a broadband antenna), the use of a groundplane will not be effective unless the dielectric constant ($\epsilon_r$) has a 1/(frequency)$^2$ functional dependence and low loss. No material has been found that exhibits both the low loss and the required $\epsilon_r$ dependence over the large bandwidth that is desired for some antenna systems.

One way to overcome these problems is to use a three-dimensional photonic bandgap crystal as the antenna substrate. A photonic bandgap crystal is a periodic dielectric structure that exhibits a forbidden band of frequencies, or bandgap, in its electromagnetic dispersion relation. These photonic bandgap materials are well known in the art. For example, see K. M. Ho, C. T. Chan and C. M. Soukoulis, "Existence of Photonic Band Gap in Periodic Dielectric Structures", *Phys. Rev. Lett.* 67, 3152 (1990) and E. Yablonovitch, "Photonic Bandgap Structures", *J. Opt. Soc. Am.* B 10, 283 (1993).

The effect of a properly designed photonic bandgap crystal substrate on a radiating antenna is to eject all of the radiation from the substrate into free space rather than absorbing the radiation, as is the case with a normal dielectric substrate. The radiation is ejected or expelled from the crystal through Bragg scattering. This concept has been demonstrated and described in E. R. Brown, C. D. Parker and E. Yablonovitch, "Radiation Properties of a Planar Antenna on a Photonic-Crystal Substrate", *J. Opt. Soc. Am.* B 10, 404 (1993).

This reference describes the design, fabrication and experimental verification of a planar antenna that utilizes a photonic bandgap crystal with a bandgap between 13 and 16 GHz. Although this is an improvement over the conventional dielectric substrates described above, there is still a need for a substrate that will cover a wider range of frequencies (a substrate with a larger bandgap) for broadband planar antenna systems and other applications that require broadband frequency selective surfaces. Currently, one cannot fabricate a single photonic bandgap crystal that will cover a wide range of frequencies.

SUMMARY OF THE INVENTION

The purpose of the present invention is to provide a broadband antenna system that utilizes multiple photonic bandgap crystals to achieve nearly 100 percent power efficiency over a larger range of frequencies than prior antenna systems. The photonic bandgap crystal substrate described in this invention can also be used in applications that require a broadband frequency selective surface. Since the reflection occurs through Bragg scattering, it is omnidirectional in nature. This makes photonic bandgap substrates appropriate for applications that require "low observable" surfaces as well.

The invention accomplishes these goals by providing multiple custom tailored photonic bandgap crystals for use as a substrate in a broadband antenna system. Each of the custom tailored crystals is designed to cover a specific range of frequencies. After fabrication, the multiple crystals are attached together to form a photonic bandgap substrate whose bandgap varies as a function of location on the substrate.

A broadband antenna that can cover a wide frequency range and whose active region shifts as a function of frequency can then be placed on this custom tailored photonic bandgap substrate such that the active region of the antenna is always on a crystal whose bandgap corresponds to the operating frequency of the active region.

In the preferred embodiment, a log-periodic array antenna is placed on the custom tailored substrate. A log-periodic array antenna consists of several dipole elements which are each of different lengths and different relative spacings. For a given frequency within the antenna's operating range, there will be one dipole array that is the active region of the antenna. As the operating frequency changes, the active region shifts to a different part of the log-periodic array. The log-periodic antenna is placed on the photonic bandgap substrate such that the photonic bandgap crystal adjacent to any given dipole array has a bandgap and spacing from the dipole array that accommodates the operating frequency of that dipole array. The result is a nearly 100 percent efficient broadband antenna system whose frequency range is not limited by the relatively narrow bandgap of individual photonic bandgap crystals.

These and other features and advantages of the invention will be apparent to those skilled in the art from the following detailed description of preferred embodiments, taken together with the accompanying drawings, in which:

DESCRIPTION OF THE DRAWINGS

FIG. 4 is a graph, taken from the Ho et al reference, showing the bandwidth to midband frequency ratio as a function of refractive index ratio for a fixed dielectric structure.

FIG. 5 is a table that lists the properties of different groups of microwave ceramics.

FIG. 6 is a perspective view illustrating a manufacturing method for photonic bandgap crystals.

DETAILED DESCRIPTION OF THE INVENTION

Figure 1:
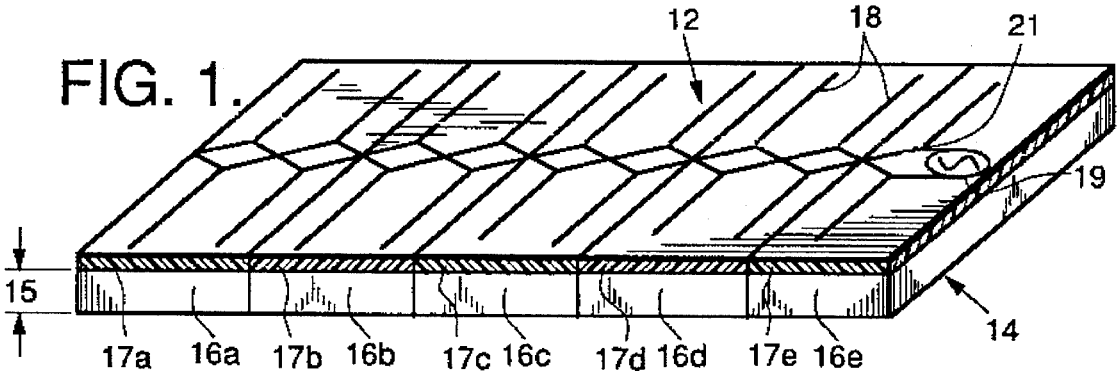
FIG. 1 is a perspective view of the preferred embodiment with a log-periodic array antenna disposed on a series of photonic bandgap crystals.

FIG. 1 illustrates the general principals of the preferred embodiment of the invention. A broadband log-periodic dipole array antenna 12 is disposed on a photonic bandgap substrate 14 consisting of a series of photonic bandgap crystals 16*a*–16*e* that are attached together side by side with adhesive.

Log-periodic dipole array antennas, as described in *The Electrical Engineering Handbook,* pp. 868–869, edited by Richard C. Dorf, CRC Press, London (1993), are well known in the art. A log-periodic dipole array antenna consists of several conductive dipole elements 18, each of which has a different length and a different relative spacing. A signal generator 19 is used to excite the dipole elements. The element lengths and relative spacings, beginning from the feed point 2 for the antenna 12, increase smoothly in dimension, being greater for each successive element 18 in the antenna 2. This design permits changes in frequency to be made without greatly affecting the electrical characteristics of the antenna 2. For a given frequency within the operating range of the antenna 12, there will be one dipole element 18 that is the active region of the antenna 12. As the operating frequency of the antenna 12 changes, the active region transitions smoothly to another dipole element 18.

The log-periodic array antenna 12 is placed on the photonic bandgap substrate 14 such that the photonic bandgap crystal 16 adjacent to any given dipole element 18 has a bandgap that accommodates the operating frequency of that dipole element 18. The bandgap of each photonic bandgap crystal 16 is, therefore, custom tailored to accomodate the frequency range of the dipole elements 18 that are adjacent to it. As a result, the photonic bandgap substrate acts as an efficient reflector that is capable of accomodating the full range of operating frequencies of the broadband antenna 12.

Each photonic bandgap crystal 16 ejects or "reflects" all of the radiation that impinges on it back towards the source of the radiation through Bragg scattering, as long as the radiation falls within the bandgap of the crystal. Since the reflection occurs through Bragg scattering, it is omnidirectional and nonspecular. This makes photonic bandgap substrates suitable for applications requiring "low observable" surfaces as well. In a conventional reflecting groundplane, consisting of a uniform dielectric in front of a conducting groundplane, most of the radiation is absorbed by the dielectric or trapped as a result of total internal reflection. A further requirement is that each dipole element 18 must be spaced from its adjacent photonic bandgap crystal 16 so that the radiation reflected from the crystal arrives at its antenna source in phase with radiation that is emitted by the antenna in a direction away from the crystal at the midband wavelength. This is accomplished by placing a series of spacers 17*a*–17*e* between the antenna 12 and the photonic bandgap crystals 16*a*–16*e*. The spacers are preferably made of low dielectric, low loss foam, such as Emerson & Cummings SH type rigid polyurethane with a density of 8.75 pounds per cubic foot. The spacer 17 thickness over each bandgap crystal 16 is generally made so that the distance between the dipole elements 18 and the bottom of their adjacent bandgap crystal 16 is approximately equal to ¼ of the dipole's midband wavelength.

The present invention differs from prior art antenna systems in that prior art antenna systems only utilized one photonic bandgap crystal 16 and did not utilize an antenna whose operating frequency varied as a function of position on the antenna (such as a log-periodic antenna). This means that the bandwidth of these prior art antenna systems are limited by the bandgap of the single photonic bandgap crystal 16 that is used. The present invention takes the concept of using photonic bandgap crystals 16 as antenna substrates one step further by custom designing several different crystals, each with a different bandgap, and assembling them as described to provide an efficient wide bandwidth reflecting groundplane for a broadband antenna 12.

Figure 2:
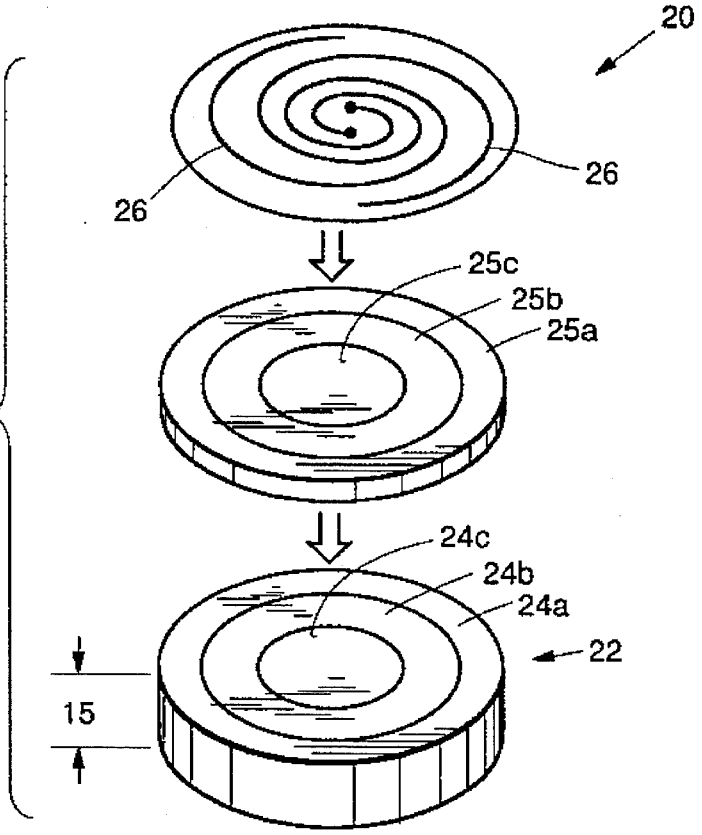
FIG. 2 is an exploded perspective view of an embodiment that utilizes a broadband spiral antenna disposed on a series of photonic bandgap crystals that are fabricated in the form of concentric annular rings.

FIG. 2 illustrates an embodiment which utilizes a broadband spiral antenna 20 in place of a log-periodic dipole array antenna 18. In this embodiment, the photonic bandgap substrate 22 consists of photonic bandgap crystals 24*a*–24*c* fabricated in the form of concentric annular rings. A series of spacers 25*a*–25*c* are fabricated in the form of concentric annular rings and placed on top of the photonic bandgap substrate. The spacers 25 perform the same function as the spacers in FIG. 1, described above. The spiral antenna 20 is disposed on the spacers 25. The antenna 20 has two spiral arms 26 that become active and radiate when they approach one wavelength in circumference. Thus, the active region moves radially outward as the frequency of operation decreases. The bandgap of each photonic bandgap crystal is selected to match the corresponding active regions.

Figure 3:
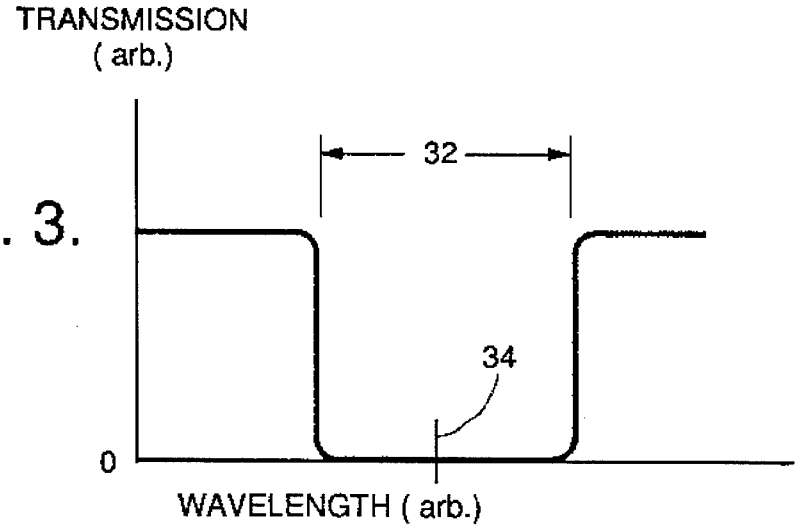
FIG. 3 is a graph that illustrates the relationship between the bandwidth and midband wavelength of a photonic bandgap material.

FIG. 3 defines the bandwidth 32 and midband wavelength 34 of an arbitrary photonic bandgap crystal. The bandwidth is simply the highest frequency (or shortest wavelength) that is transmitted or "allowed" in the crystal minus the lowest frequency (or longest wavelength) that is transmitted or "allowed". The midband wavelength corresponds to the frequency that falls in the center of the bandwidth. The midband wavelength and the frequency bandwidth are defined within the dielectric material, that is with respect to the refractive index of the dielectric material.

The first step in choosing an appropriate dielectric material is to decide what bandwidth to midband frequency or wavelength ratio one needs. The higher this ratio, the broader is the crystal's frequency range. FIG. 4 is a graph that can be used to select a dielectric material that will result in a photonic bandgap crystal 16 with a particular bandwidth 32 to mid-bandwidth 34 ratio. This graph shows the bandwidth 32 to midband frequency 34 or wavelength ratio as a function of the refractive index ratio between the dielectric material and air for a volumetric ratio of air holes to dielectric material of 81 percent (81 percent of the crystal is air). The bandwidth 32 to midband frequency 34 ratio saturates at 0.46 with a dielectric material that has a refractive index of 8 or greater. In the embodiments of FIGS. 1 and 2, a bandwidth to midband frequency ratio of 0.46 is preferred; therefore, a material with a refractive index of 8 or greater (a relative dielectric constant ($\epsilon_r$) of 64 or greater)

should be used. In FIG. 5, part of which was taken from W. Wersing, "High Frequency Ceramic Dielectrics and their Applications for Microwave Components", *Electronic Ceramics,* edited by B.C.H. Steele, Elsevier, London (1990), the properties of different groups of microwave dielectrics are listed. One group of dielectrics that has the preferred refractive index is magnesium-calcium-titanate ($Mg_2CaTi_4$). Magnesium-calcium-titanate is a two-phase material made from magnesium titanate ($Mg_2Ti_4$) and calcium titanate ($CaTiO_3$) in varying ratios. For low values of $\epsilon_r$, the mixture is mostly magnesium titanate, whereas for high values of $\epsilon_r$, the mixture is mostly calcium titanate.

Once the dielectric material is chosen, the photonic bandgap crystal 16 can be manufactured as shown in FIG. 6. As mentioned above, manufacturing methods for photonic bandgap crystals are well known in the art. For example, see E. Yablonovitch, "Photonic Bandgap Structures", *J. Opt. Soc. Am.* B 10, 283 (1993). The preferred method is to cover the dielectric material 36 with a mylar mask 38 that consists of an equilateral triangular array of holes 40. The mask 38 can be held in place by an adhesive (not shown). The spacing between the holes on the mask 38 defines the lattice spacing. The midband frequency of the photonic bandgap crystal 16 is determined by the lattice spacing. More specifically, the midband frequency of the photonic bandgap crystal 16 is one-half the lattice spacing, therefore, the mask 38 should be designed with a specific midband frequency in mind so that the holes 40 on the mask 38 can be spaced appropriately. Once the mask 38 is in place on the dielectric material 36, three drilling operations 44 are conducted through each hole 40. The drilling operations 44 are conducted 35 degrees off normal incidence and spread out 120 degrees on the azimuth with respect to the each other. The resulting criss-cross of holes 46 below the surface of the dielectric material 36 produces a fully three-dimensional periodic face-centered cubic structure. This structure is comprised of two interpenetrating face-centered cubic Bravais lattices. The drilling can be done by a real drill bit for a photonic bandgap crystal 16 that is designed for microwave frequencies or by reactive ion etching for a crystal that is designed for optical frequencies. The diameter of the drilled holes 46 determines the volumetric ratio of air holes to dielectric material 36 remaining after the drilling operation.

Lattice spacings for a system of photonic bandgap crystals can be calculated in the following manner. Typically 10 dB of microwave reflection is achieved per lattice spacing. For a photonic bandgap crystal to reflect most radiation within its bandgap range, the crystal thickness 15 should be three times its lattice spacing, corresponding to 30*d*B of reflection.

In the preferred embodiment of FIG. 1, five custom designed photonic bandgap crystals 16*a*–16*e* located side by side are used to achieve operation in the 2 to 18 GHz frequency range. The crystals have the following characteristics:

| | Midband Freq. (GHz) | Bandwidth (GHz) | Thickness (Cm) |
|---|---|---|---|
| #1 | 14.7 | 6.76 | 0.382 |
| #2 | 9.4 | 4.32 | 0.598 |
| #3 | 5.9 | 2.71 | 0.953 |
| #4 | 3.7 | 1.7 | 1.519 |
| #5 | 2.3 | 1.06 | 2.444 |

The photonic bandgap crystal 16 that has the lowest midband wavelength 34 should be adjacent to the set of dipole elements 8 that radiate the shorter wavelengths, while the crystal that has the highest midband wavelength 34 should be adjacent to the set of dipole elements that radiate the longer wavelengths. The other three crystals should be placed between the two end crystals adjacent to dipole elements 8 which radiate at a wavelength that corresponds to the unique midband wavelength 32 of the photonic bandgap crystal 16.

A system of photonic bandgap crystals for operation over a very large frequency range could also be designed.

For operation in 45 MHz to 20 GHz range, 13 custom designed photonic bandgap crystals would preferably be used. The crystals would have the following characteristics:

| | Midband Freq. (GHz) | Bandwidth (GHz) | Thickness (Cm) |
|---|---|---|---|
| #1 | 16.26 | 7.48 | 0.346 |
| #2 | 10.18 | 4.68 | 0.552 |
| #3 | 6.37 | 2.93 | 0.882 |
| #4 | 3.99 | 1.84 | 1.409 |
| #5 | 2.50 | 1.15 | 2.248 |
| #6 | 1.56 | 0.720 | 3.603 |
| #7 | 0.980 | 0.450 | 5.736 |
| #8 | 0.610 | 0.280 | 9.215 |
| #9 | 0.382 | 0.176 | 14.715 |
| #10 | 0.239 | 0.110 | 23.519 |
| #11 | 0.150 | 0.069 | 37.474 |
| #12 | 0.094 | 0.043 | 59.799 |
| #13 | 0.059 | 0.027 | 95.273 |

Numerous other variations and alternate embodiments will occur to those skilled in the art without departing from the spirit and scope of the invention. For example, the photonic bandgap crystal substrate is not limited to the geometries described in this description. Similarly, other types of broadband antennas can be used. Often the type of geometry used for the crystal substrate will be dictated by the type of broadband antenna that is used. In addition, other types of dielectrics can be used. If a dielectric material is used that results in a photonic bandgap crystal 16 with a narrower or broader bandwidth than that described in this invention, then the number of different crystals needed for the photonic bandgap substrate can be adjusted. Accordingly, it is intended that the invention be limited only in terms of the appended claims.

We claim:

1. An efficient broadband antenna system, comprising:

a photonic bandgap substrate with a bandgap and midband frequency that vary as a function of position on said substrate and a broadband antenna on said photonic bandgap substrate, the operating frequency of said antenna varying as a function of position on said antenna, said antenna positioned on said substrate so that the operating frequency of any portion of said antenna falls within the bandgap of the portion of said photonic bandgap substrate that is adjacent to it, said photonic bandgap substrate providing a Bragg reflector for reflecting radiation emitted from said broadband antenna, wherein said photonic bandgap substrate comprises a plurality of photonic bandgap crystals, each of said crystals providing said Bragg reflector for a respective range of frequencies.

2. The system of claim 1, wherein said crystals have different midband frequencies and bandgaps from each other, and said antenna comprises different antenna portions on respective crystals, each of said antenna portions responding to a frequency range that corresponds to the bandgap of its respective crystal.

3. The system of claim 2, wherein said broadband antenna comprises a log-periodic antenna.

4. The system of claim 2, wherein said broadband planar antenna comprises a broadband spiral antenna.

5. The system of claim 1, wherein said photonic bandgap crystals comprise a periodic dielectric structure.

6. The system of claim 5, wherein said periodic dielectric structure comprises a lattice of air holes surrounded by a high index dielectric material, said lattice having a face-centered-cubic crystal structure.

7. The system of claim 6, wherein said lattice further comprises two interpenetrating face-centered cubic Bravis lattices.

8. The system of claim 7, wherein the volumetric ratio of said air holes to said dielectric material is approximately 81 percent.

9. The system of claim 1, wherein the midband frequency of said substrate varies from approximately 2 GHz to approximately 15 GHz, and the bandwidth of said substrate varies from approximately 1.1 Ghz to approximately 6.8 GHz.

10. The system of claim 1, wherein the midband frequency of said substrate varies from approximately 0.06 GHz to approximately 16 GHz, and the bandwidth of said substrate varies from approximately 0.03 Ghz to approximately 7.5 GHz.

* * * * *